US005682636A

United States Patent [19]

Agustin

[11] Patent Number: 5,682,636

[45] Date of Patent: Nov. 4, 1997

[54] DEVICE FOR REMOVING COBWEBS

[76] Inventor: Hermenegildo C. Agustin, 318 Naples St., San Francisco, Calif. 94112

[21] Appl. No.: 643,793

[22] Filed: May 7, 1996

[51] Int. Cl.[6] ..... A47L 25/00

[52] U.S. Cl. ..... 15/3; 15/22.1; 15/97.1

[58] Field of Search ..... 15/3, 3.53, 22.1, 15/23, 28, 97.1

[56] References Cited

U.S. PATENT DOCUMENTS 3,661,018 5/1972 Keefer et al. ..... 15/22.1

4,103,382 8/1978 Gitt ..... 15/104.001

4,748,712 6/1988 DiGiovanni ..... 15/339

4,901,391 2/1990 Athalye ..... 15/3

*Primary Examiner*—Terrence Till

[57] ABSTRACT

A device for removing cobwebs comprising a handle (6) housing electrical storage cells (16), and a motor (14); said motor (14) being drivably connected to a length of rod (8) which when made to come in contact with cobwebs while being spun by the energized motor (14) causes cobwebs (30) to stick to and get tightly wound around said rod resulting in the effective removal and disposal of the cobwebs.

10 Claims, 3 Drawing Sheets

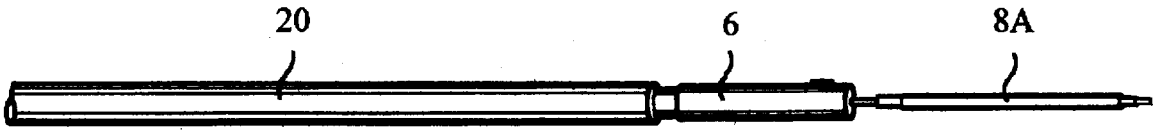
Fig. 4
Fig 5A
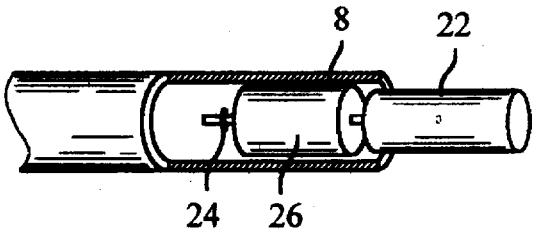
Fig 5B
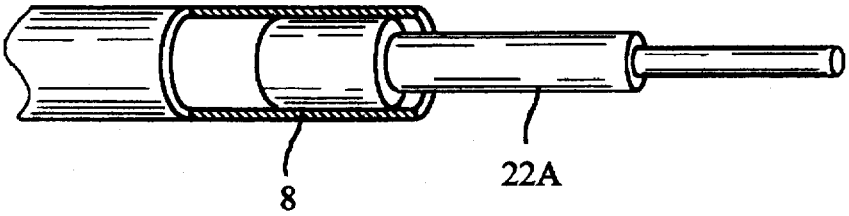
Fig 5C
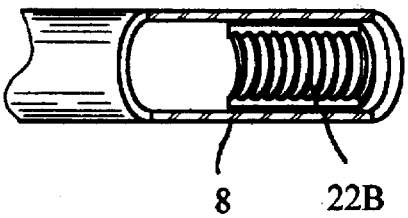

DEVICE FOR REMOVING COBWEBS

BACKGROUND

1. Field of Invention

This invention relates to cleaning devices, specifically to a device for effectively removing cobwebs.

2. Description of Prior Art

The problem of removing cobwebs with ordinary household devices has existed for quite sometime.

The use of a broom is not satisfactory since the cobwebs tend to stick to the broom strands from which they must later be removed. Furthermore, swept cobwebs, when accumulated in quantity on the broom, tend to drop to the floor and other surfaces thus creating more areas to be cleaned. In many cases, the person cleaning elevated surfaces of cobwebs catches them on his/her head. Sweeping with a broom also tend to cause some cobwebs that may have accumulated on the broom to be redeposited even more firmly on the very surface being cleaned. Brooms are also heavy and awkward when used to clean nooks and crannies where cobwebs collect. Between boxes, jars and similar articles, the use of a broom requires moving these articles. Between walls and appliances, brooms are simply too difficult to use without first moving said appliances away from the wall. Furthermore, since most of a broom's weight is located on the remote end of its handle, sweeping elevated surfaces subjects the user's wrist to undue strain. When used on high ceilings or other elevated surfaces, the broom usually requires the use of a ladder thus adding a danger factor.

Dusters, mops and similar clearing tools basically share the same problems with the broom that are described above.

Vacuum cleaners on the other hand, aside from being noisy and heavy, do not efficiently suck cobwebs which tend to stick to the opening and inner surfaces of the suction tube. When working in tight spaces next to soft materials such as curtains, the vacuum cleaner has a tendency to accidentally suck said soft materials and thus disrupt an otherwise orderly process of cleaning. Vacuum cleaners are also relatively cumbersome to set up prior to use because of the need to unravel the electrical chord and connect various attachments. In many cases, the user must constantly navigate the canister around furniture and comers since it needs to be near the user all the time. The weight and bulk of the vacuum cleaner wand also make its use for cleaning cobwebs relatively tiring and unpleasant. When used on high ceilings or rafters, vacuum cleaners normally require the use of a ladder which is relatively dangerous.

The inventor is aware of several patents within the cleaning devices category: U.S. Pat. No. 4,534,080 is specifically designed for cleaning chimneys, and, is not suitable for use in removing cobwebs; U.S. Pat. Nos. 4,238,866 (1980) and 4,168,559 (1979) pertain to devices for cleaning leaves and other debris from rain gutters and elevated structures and utilize flexible elements or lines for scooping or throwing off leaves and other debris; U.S. Pat. Nos. 4,271,594 (1981) and 5,279,102 (1994) are grass trimmers utilizing rotating filaments that do not relate to cobweb removal; U.S. Pat. No. 3,822,432 (1974), is designed to perform as a dental hygiene appliance and is not relevant to cobweb cleaning. U.S. Pat. No. 4,748,712 is the only one among those uncovered that specifically addresses the removal of cobwebs. However, it is readily apparent that it is basically an ordinary vacuum cleaner which, by virtue of its bulk, weight and process of cleaning cobwebs presents many of the problems enumerated above.

OBJECTS AND ADVANTAGES

Accordingly, several objects and advantages of the present invention are:

a) to provide a cobweb cleaning device that is fast and efficient;

b) to provide a cobweb cleaning device designed for quick and easy removal of the collected cobwebs from the cleaning device itself;

c) to provide a cobweb cleaning device that requires the least disturbance of items on or near the surfaces being cleaned;

d) to provide a cleaning device that is less stressful on the wrist than conventional devices such as a vacuum cleaner or a broom;

e) to provide a cobweb cleaning device that can easily access narrow gaps between ordinary items such as tools, boxes, jars, etc.;

f) to provide a cobweb cleaning device that is light and portable;

g) to provide a cobweb cleaning device that does not require the use of a ladder when used on high ceilings h) to provide a cobweb cleaning device that is quieter than a vacuum cleaner;

i) to provide a cobweb cleaning device that consumes less energy than an ordinary vacuum cleaner;

DRAWINGS FIGURES

In the drawings, the same parts have the same number.

FIG. 4 is a perspective view of the device with an attached pole and the telescopic rod FIG. 5*a* is an enlarged fragmentary view of the rod with a free wheeling end cap.

FIG. 5*b* is an enlarged fragmentary view of the rod with a graduated end cap.

FIG. 5*c* is an enlarged fragmentary view of the rod with a screw insert.

Figure 6:
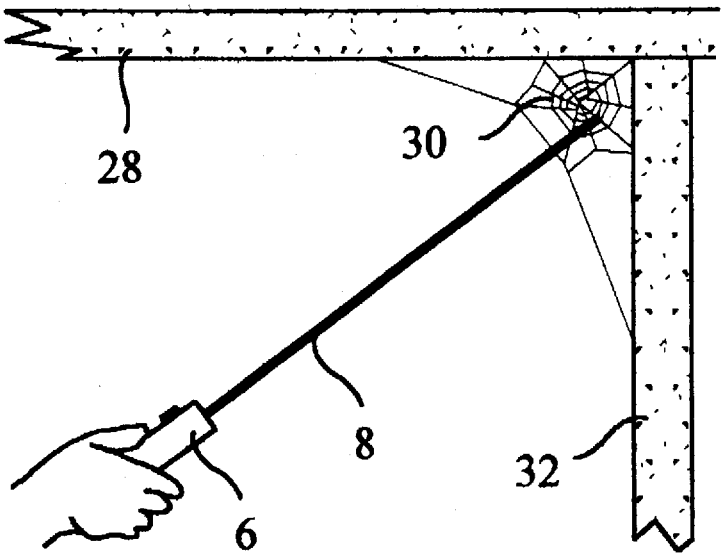

FIG. 6 is a perspective view of the device in use with the ceiling and the wall being shown in section.

Figure 7:
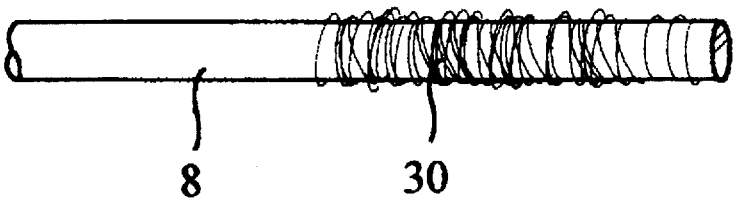

FIG. 7 is an enlarged fragmentary view of the rod 8 after it has collected the cobwebs.

REFERENCE NUMERALS IN DRAWINGS

| | | | |
|---|---|---|---|
| 6 | handle | 8 | rod |
| 8A | telescopic rod | 10 | switch |
| 12 | motor shaft | 14 | motor |
| 16 | electrical storage cell | 18 | connector |
| 20 | extension means | 22 | free-wheeling end cap |
| 22A | graduated end cap | 22B | screw insert |
| 24 | retaining ring | 26 | retainer plug |
| 28 | ceiling | 30 | cobweb |
| 32 | wall | | |

DESCRIPTION—FIGS. 1 TO 7

Figure 1:
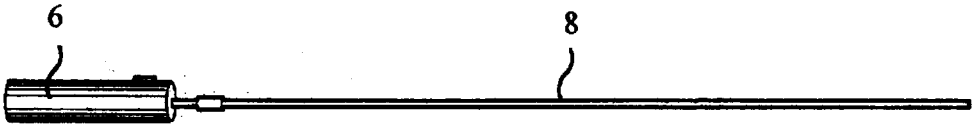
FIG. 1 is a perspective view of the device as a whole.
Figure 2:
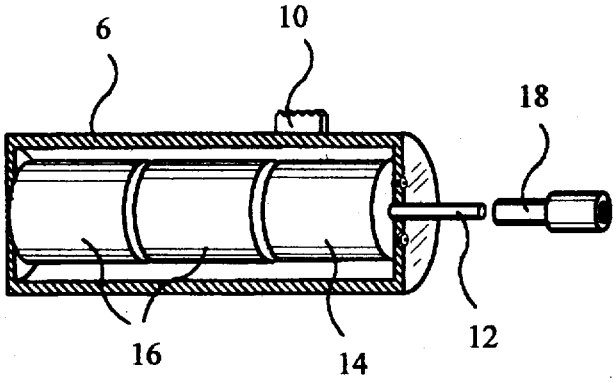
FIG. 2 shows a detailed illustration of the handle means.
Figure 3:
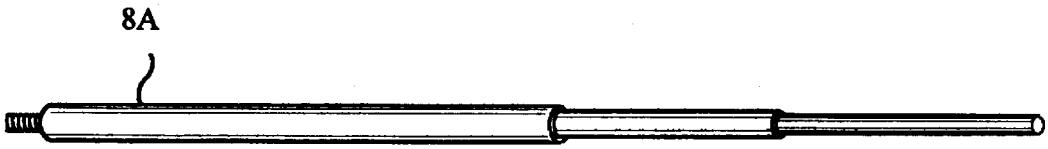
FIG. 3 shows a telescopic rod.

A typical embodiment of the present invention is illustrated in FIG. 1 which shows the handle 6 and the rod 8. FIG. 2 shows a preferred embodiment of the handle 6 which houses the electrical storage cells 16, the motor 14 and motor shaft 12 to which connector 18 is secured. FIG. 2 further shows the switch means 10 situated on the outside of the handle 6. Connector 18 allows the rod 8 in FIG. 1 to be removably secured to the motor shaft 12. FIG. 3 illustrates a collapsible rod 8A which is another embodiment of rod 8 in FIG. 1. FIG. 4 is a perspective view of the handle 6, the collapsible rod 8A (shown collapsed) and an extension 20 used to extend the handle 6. FIG. 5A illustrates an embodiment of rod 8 where a flee-wheeling end cap 22 is attached to the remote end of rod 8. Its purpose is to minimize the tendency of the tip of the rod 8 to travel in the direction of rotation when touching a surface thereby permitting more precise control of the device. Free-wheeling end cap 22 is held in place by insert 26 and retaining ring. 24. FIG. 5B illustrates another embodiment of rod 8 wherein a graduated end cap 22A with a progressively smaller diameter tip is used for the purpose of minimizing the tendency of the tip of the rod 8 to travel in the direction of rotation when touching a surface. FIG. 5C is yet another embodiment of rod 8 which shows a screw insert 22B at the end of rod 8 to allow acceptance of various cleaning tools such as a feather duster (not shown). FIG. 6 shows a perspective view of the present invention being used to remove cobwebs 30 attached to the corner of a ceiling 28 and a wall 32, with the ceiling and the wall being shown in section. FIG. 7 is an enlarged fragmentary view of the rod 8 after it has collected the cobwebs 30.

OPERATION

When switch 10 is turned on, the motor 14 is energized and causes the motor shaft 12, the connector 18 and the rod 8 to spin with it. The user then simply touches cobwebs 30 with the spinning rod 8 which causes said cobwebs to stick to and get tightly wound around said spinning rod 8 whereon they continue to collect. Since the rod 8 is light and thin, it is easily positioned between tight spaces where cobwebs are frequently found. To dispose of the cobwebs so collected, the user simply turns off the switch 10 and pushes said cobwebs off the rod 8 with his/her thumb and forefinger (optionally, a piece of tissue paper or similar material may be used to avoid touching the cobwebs). The collection of cobwebs so removed is so dense that it is usually no more than the size of a cigarette butt.

SUMMARY, RAMIFICATIONS AND SCOPE

Other cleaning devices such as brooms and vacuum cleaners are rendered less effective for cleaning cobwebs by the sticky nature of cobwebs. By contrast, this invention is designed to utilize that sticky nature of cobwebs to successfully capture them around a rapidly spinning rod. Once the spinning rod makes contact with a strand of cobweb the rod begins to "reel in" the rest of the interconnected strands until they are all tightly wound around it. This happens so quickly that the cobwebs appear to collapse toward the rod as if being sucked by a powerful magnet. Having assumed the rod's own slim tubular shape these collected cobwebs are generally kept away from the surface being cleaned thereby avoiding the likelihood that they will be redeposited on the surface from which they were removed. The use of a slim rod as cleaning element adds the advantage of being easily positioned between narrow gaps and comers where cobwebs generally collect. In contrast with conventional devices, this invention also eliminates secondary cleaning chores occasioned by cobwebs that might have fallen to the floor. Removing collected cobwebs from the rod of the current invention is both quick and easy as it involves a mere push by the thumb and forefinger along the soiled portion of the rod. By comparison, removing cobwebs that have been draped upon the broom or, in the case of a vacuum cleaner, the suction cup, etc. is time consuming and less certain (cobwebs are so thin that it is hard to judge by sight whether they have been completely removed). Because, as illustrated in the preferred embodiment, the invention is cordless, it is light and is quickly put to use without much tool setup and preparation as is the ease with a vacuum cleaner. Furthermore, since most of the present invention's weight is located in the handle, it applies much less stress on the user's wrist as compared to a broom or a vacuum cleaner. The reader will understand as well that the present invention will be lighter than most brooms and all vacuum cleaners thus making it much less tiresome to use on walls and other elevated surfaces. My cobweb cleaning device also has a simpler design and is quieter than a vacuum cleaner.

I claim:

1. A device for removing cobwebs comprising:

a) a handle, b) a rotary drive housed within said handle, and c) means for removing cobwebs comprising a rod removeably secured to said drive means whereby said rod, when made to come in contact with cobwebs while spinning will cause said cobwebs to stick to and get wound around said rod resulting in the effective collection and disposal of said cobwebs.

2. The device for removing cobwebs as set forth in claim 1 which includes electrical storage cells carried within said handle and are operatively connected to said drive means to provide power thereto.

3. The device for removing cobwebs as defined in claim 2 wherein said electrical storage cells are rechargeable from a source external to said device for removing cobwebs.

4. The device for removing cobwebs as set forth in claim 1 which includes a control means on said handle means and operatively connected to said drive means whereby said drive means may be turned on or off.

5. The device for removing cobwebs as defined in claim 4 wherein said handle is removably secured to an extension pole.

6. The device for removing cobwebs as set forth in claim 1 wherein said rod is further characterized as a plurality of telescopically joined tubular sections.

7. The device for removing cobwebs as defined in claim 1 wherein said drive is an electric motor.

8. a device for removing cobwebs as defined in claim 1 wherein said rod has a connecting means for accepting other cleaning attachments to the end of said rod.

9. A device for removing cobwebs comprising:

a) an elongated handle b) a power means for providing rotational energy and, c) means for removing cobwebs comprising a rod of predetermined length removably attached to said motor, whereby said rod, when made to come in contact with cobwebs while being spun by the power means will cause said cobwebs to stick to and get wound around said rod resulting in the effective collection and disposal of the cobwebs.

10. A device for removing cobwebs as set forth in claim 9 wherein said handle includes a means for accepting an extension pole.

* * * * *